US011844368B2

(12) United States Patent
Kannisto et al.

(10) Patent No.: US 11,844,368 B2
(45) Date of Patent: Dec. 19, 2023

(54) FLAVOURED MOIST ORAL POUCHED NICOTINE PRODUCT COMPRISING MONOGLYCERIDE

(71) Applicant: Swedish Match North Europe AB, Stockholm (SE)

(72) Inventors: Jenny Kannisto, Hisings Backa (SE); Mårten Kindvall, Gothenburg (SE); Lars Jonsson, Floda (SE)

(73) Assignee: SWEDISH MATCH NORTH EUROPE AB, Stockholm (SE)

( * ) Notice: Subject to any disclaimer, the term of this patent is extended or adjusted under 35 U.S.C. 154(b) by 265 days.

(21) Appl. No.: 16/765,638

(22) PCT Filed: Dec. 14, 2018

(86) PCT No.: PCT/EP2018/084982

§ 371 (c)(1),
(2) Date: May 20, 2020

(87) PCT Pub. No.: WO2019/115778

PCT Pub. Date: Jun. 20, 2019

(65) Prior Publication Data

US 2020/0297026 A1 Sep. 24, 2020

(30) Foreign Application Priority Data

Dec. 15, 2017 (NO) ..... 20172007
Dec. 15, 2017 (SE) ..... 1751555-2
(Continued)

(51) Int. Cl.
*A24B 15/32* (2006.01)
*A24B 13/00* (2006.01)
(Continued)

(52) U.S. Cl.
CPC ..... *A24B 15/32* (2013.01); *A24B 13/00* (2013.01); *A24B 15/16* (2013.01); *A24B 15/385* (2013.01); *A24B 15/403* (2013.01); *A24B 15/42* (2013.01)

(58) Field of Classification Search
CPC ..... A24B 13/00; A24B 15/10; A24B 15/16; A24B 15/42; A24B 15/385; A24B 15/403
(Continued)

(56) References Cited

U.S. PATENT DOCUMENTS 9,629,832 B2 4/2017 Hansson et al.
2011/0214681 A1* 9/2011 Axelsson ..... A24B 15/16 131/369
(Continued)

FOREIGN PATENT DOCUMENTS

EP 2428450 B1 3/2012
EP 3087852 A1 11/2016
(Continued)

OTHER PUBLICATIONS

Federal Register—Notices, Jan. 2009, pp. 712-719, vol. 74, No. 4.
(Continued)

*Primary Examiner* — Michael J Felton
*Assistant Examiner* — Ronnie Kirby Jordan
(74) *Attorney, Agent, or Firm* — Knobbe Martens Olson & Bear LLP

(57) ABSTRACT

The present disclosure relates to an oral pouched nicotine product comprising a moist filling material and a saliva-permeable pouch of a packaging material enclosing the moist filling material, wherein the moist filling material comprises a particulate non-tobacco material; a non-encapsulated non-particulate flavouring agent; a nicotine source; a pH adjusting agent; a monoglyceride; and tobacco material
(Continued)

within the range of from 0% to % by weight, based on the total weight of the moist filling material.

14 Claims, 6 Drawing Sheets

(30) Foreign Application Priority Data

Mar. 29, 2018 (SE) ..... 1850358-1
Oct. 24, 2018 (SE) ..... 1851317-6

(51) Int. Cl.
*A24B 15/16* (2020.01)
*A24B 15/38* (2006.01)
*A24B 15/40* (2006.01)
*A24B 15/42* (2006.01)

(58) Field of Classification Search
USPC ..... 131/347, 352, 356, 359
See application file for complete search history.

(56) References Cited

U.S. PATENT DOCUMENTS

| | | | | |
|---|---|---|---|---|
| 2012/0298124 | A1* | 11/2012 | Shikata | A24B 13/00 131/352 |
| 2013/0152953 | A1 | 6/2013 | Mua et al. | |
| 2015/0257436 | A1* | 9/2015 | Essen | A24B 15/18 |
| 2016/0157515 | A1 | 6/2016 | Chapman et al. | |
| 2017/0157106 | A1* | 6/2017 | Rogers | A24D 1/025 |

FOREIGN PATENT DOCUMENTS

| | | | |
|---|---|---|---|
| JP | 61-35120 | A | 2/1986 |
| RU | 2608902 | C2 | 1/2017 |
| RU | 2617262 | C2 | 4/2017 |
| WO | WO 2004/056363 | A2 | 7/2004 |
| WO | WO 2007/104573 | A2 | 9/2007 |
| WO | WO 2009/056609 | A1 | 5/2009 |
| WO | WO 2010/114445 | A1 | 10/2010 |
| WO | WO 2012/069505 | A1 | 5/2012 |
| WO | WO 2012/134380 | A1 | 10/2012 |
| WO | WO 2013/109961 | A1 | 7/2013 |
| WO | WO 2014/150881 | A1 | 9/2014 |
| WO | WO 2015/009913 | A1 | 1/2015 |
| WO | WO 2015/198067 | A1 | 12/2015 |
| WO | WO 2017/098439 | A1 | 6/2017 |

OTHER PUBLICATIONS

Swedish Match "Helvit storsatsning på ZYN—nytt format och ny smak lanseras" Mar. 2018.
Swedish Search Report for 1850358-1 dated Oct. 12, 2018.
International Search Report for PCT/EP2018/084982 dated Mar. 18, 2019.
Official Methods of Analysis—15$^{th}$ Edition, 1990—Association of Official Analytical Chemists—Edited by Kenneth Helrich—966.02: "Moisture in Tobacco"—[Uploaded in 3 parts].

* cited by examiner

FLAVOURED MOIST ORAL POUCHED NICOTINE PRODUCT COMPRISING MONOGLYCERIDE

CROSS REFERENCE TO RELATED APPLICATIONS

This application is a U.S. National Phase Application of PCT International Application Number PCT/EP2018/084982, filed on Dec. 14, 2018, designating the United States of America and published in the English language, which is an International Application of and claims the benefit of priority to Swedish Patent Application No. 1751555-2, filed on Dec. 15, 2017, Norwegian Patent Application No. 20172007, filed on Dec. 15, 2017, Swedish Patent Application No. 1850358-1, filed on Mar. 29, 2018, and Swedish Patent Application No. 1851317-6, filed on Oct. 24, 2018. The disclosures of the above-referenced applications are hereby expressly incorporated by reference in their entireties.

TECHNICAL FIELD

The present disclosure relates to an oral pouched nicotine product comprising a moist filling material including a particulate non-tobacco material, such as microcrystalline cellulose, a non-encapsulated non-particulate flavouring agent, a nicotine source, a pH adjusting agent, and a monoglyceride. The oral pouched nicotine product may be free from tobacco or contain a small amount of tobacco.

BACKGROUND

Moist snuff for oral use is available in loose form or portion-packed in a saliva-permeable, porous wrapper material forming a pouch. Pouched moist snuff is typically used by the user by placing the pouch between the upper or lower gum and the lip or cheek and retaining it there for a limited period of time. The pouch material holds the tobacco in place while allowing saliva to pass into the interior of the pouched product and allowing flavours and nicotine to diffuse from the tobacco material into the user's mouth.

There are oral pouched nicotine-containing non-tobacco products available which may be offered as alternatives to oral pouched smokeless tobacco products. These oral pouched non-tobacco nicotine products are generally used in the same manner as the corresponding oral pouched tobacco-containing products and are herein referred to as oral pouched nicotine products.

Oral pouched smokeless tobacco products as well as oral pouched non-tobacco nicotine products may be produced by measuring portions of the filling material and inserting the portions into a packaging material. The packaging material forming the pouch in oral pouched products is typically a dry-laid bonded nonwoven comprising viscose rayon fibres (i.e. regenerated cellulose) and an acrylic polymer that acts as binder in the nonwoven material and provides for heat-sealing of the pouches during manufacturing thereof. The packaging material forming the pouch of the oral pouched product should during manufacturing of the pouch provide for sealing, upon storage of the pouch exhibit none or a low degree of discoloration and upon usage by a consumer preserve integrity and strength, allow for a desired release profile of nicotine and flavours and provide a pleasant mouth-feel.

The organoleptic properties, such as texture, aroma, taste, shape and appearance, of the pouched product are of high importance to the user. It is generally desirable to provide oral pouched nicotine products with rapid release of flavour and nicotine to provide an initial strong flavour experience and/or reduce nicotine craving.

WO 2004/056363 A2 relates to a nicotine-containing particulate material comprising a combination of nicotine or a pharmaceutically acceptable salt, complex or solvate thereof and a microcrystalline cellulose.

WO 2007/104573 A2 relates to the use of a nicotine-cellulose combination for the preparation of a snuff composition. The nicotine-cellulose combination may be enclosed in a membrane material.

WO 2010/114445 A1 relates to a plant fiber product for oral use containing a mixture of plant fibers, such as tea, coffee, tobacco, cocoa, maize, herbs, yerba mate or cellulose, and an alginate composition dispersed in the product and comprising water, alginate and an added substance intended to be released from the product when said product is used. The added substance may be an active substance, such as nicotine, or a taste substance.

WO 2012/134380 A1 relates to a product for oral delivery of nicotine containing a core comprising a powder of at least one free nicotine salt, at least one pH adjusting agent and at least one filler, and a water insoluble pouch enclosing the powder. As disclosed in WO 2012/134380 A1, many nicotine salts are known to be physically and chemically stable. By using a suitable nicotine salt, instead of nicotine base, the problems with nicotine oxidation and volatility can be reduced or avoided. By using a nicotine salt it is not necessary to form a combination between the nicotine and other components in the powder to protect the nicotine from oxidation and high volatility. The nicotine salt can be free, i.e. it only needs to be mixed together with the other components in the powder. Moreover, the at least one pH adjusting agent ensures that when the powder is dissolved in saliva, a sufficiently high local pH is obtained. Such a high local pH is important to ensure that the dissolved nicotine is unprotonated and hence can be effectively absorbed through the oral mucosa.

WO 2015/009913 A1 relates to a method for incorporating liquid nicotine into an oral product, comprising (a) mixing liquid nicotine with cellulosic fiber to produce a cellulosic fiber-nicotine mixture; (b) mixing the cellulosic fiber-nicotine mixture with one or more binders to form an oral product pre-molding mixture; and (c) molding the oral product pre-molding mixture into an oral product. It is stated that compression molding techniques call for dry ingredients. Flavorants and placticizers such as triglycerides are mentioned. There is also disclosed a cellulosic-fiber-nicotine porous pouch.

US 2010/0282267 discloses a flavorant encapsulated by a lipid coating comprising a triglyceride, a monoglyceride or a combination thereof. There is also disclosed a product comprising tobacco and said encapsulated flavorant.

WO2013/109961 discloses an oral product comprising a mouth-stable polymer matrix, cellulosic fibers embedded in said mouth-stable polymer matrix, and nicotine or a derivative thereof dispersed in the mouth-stable polymer matrix. The coating material may be acetylated monoglyceride.

WO 2014/150881 discloses nicotine-containing products that also contain anatabine. The products may be pouched. The products may be a smokeless product such as pre-formed moist snuff, or be substantially free of tobacco plant tissue. The products may contain flavorants, fillers and plasticizers and pH stabilizers. The plasticizer may be medium chain triglycerides.

EP3087852 discloses an oral pouched non-tobacco nicotine-containing snuff product having a rectangular shape, said product comprising a filling material comprising nicotine or a salt thereof and one of more particulate fillers such as microcrystalline cellulose.

WO 2015/198067 discloses a powder for delivery to the oral cavity. The powder comprises at least two populations of particles. A first population of particles comprises a stimulant, and a second population comprises a flavourant. The stimulant may comprise nicotine. The powder may further comprise a population comprising an enhancer. The enhancer may comprise a hydrophobic material such as monoglycerides, diglycerides or triglycerides.

US 2004/123873 discloses a nontobacco or herbal moist snuff composition comprising an herbal component comprising, or consisting essentially of, corn silk, and a method for production of said composition.

WO 2015/009913 discloses methods and systems for stabilizing nicotine and incorporating nicotine into one or more oral products. The nicotine is stabilized by mixing liquid nicotine with cellulosic fiber such that the liquid nicotine absorbs into pores of the cellulosic fiber to form a cellulosic fiber-nicotine mixture. Oral pouched nicotine-containing non-tobacco products are generally flavoured. However, a significant amount of added flavour may be lost or affected by e.g. deterioration before the product is used due to, for instance, exposure to moisture, oxidation, and evaporation of the flavours. As a result, a consumer may not enjoy the flavour as intended. Generally, this problem is greater for moist oral pouched nicotine products than for dry oral pouched nicotine products.

Another problem associated with the incorporation of flavours in pouched nicotine products is that some flavours may have a negative impact on the seal strength of the resulting pouches which may lead to seal rupture upon storage of the products. In particular, impaired seal strength upon storage is a problem for moist oral pouched products.

SUMMARY

An object of the present disclosure is to alleviate at least one of the problems discussed above, and to provide advantages and aspects not provided by hitherto known technique.

The present disclosure provides an oral pouched nicotine product comprising a moist filling material and a saliva-permeable pouch of a packaging material enclosing the moist filling material, the filing material comprising a particulate non-tobacco material; a non-encapsulated non-particulate flavouring agent; a nicotine source; a pH adjusting agent; a monoglyceride, and a tobacco material within the range of from 0% to 10% by weight.

The present disclosure also provides a use of monoglyceride for flavour preservation, prevention of pouch seal weakening and/or improved shelf life stability in an oral pouched nicotine product as described herein.

Further, the present disclosure provides a use of a combination monoglyceride and triglyceride for flavour preservation, prevention of pouch seal weakening and/or improved shelf life stability in an oral pouched nicotine product as described herein.

There is also provided a method for manufacturing the moist filling material as disclosed herein, the method comprising:

providing a mixture comprising a particulate non-tobacco material and a nicotine source such as a nicotine salt, adding monoglyceride and optionally triglyceride to the mixture comprising a particulate non-tobacco material and nicotine source thereby providing a mixture comprising particulate non-tobacco material, nicotine source, monoglyceride and optionally triglyceride, adding water to the mixture comprising particulate non-tobacco material and nicotine source such as a nicotine salt and/or to the mixture comprising non-tobacco material, nicotine source such as nicotine salt, monoglyceride and optionally triglyceride, wherein a pH adjusting agent is added in and/or after any of the foregoing steps, a non-encapsulated flavouring agent is added in and/or after any of the foregoing steps, and optionally a tobacco material is added in and/or after any of the foregoing steps.

DETAILED DESCRIPTION

Figure 1:
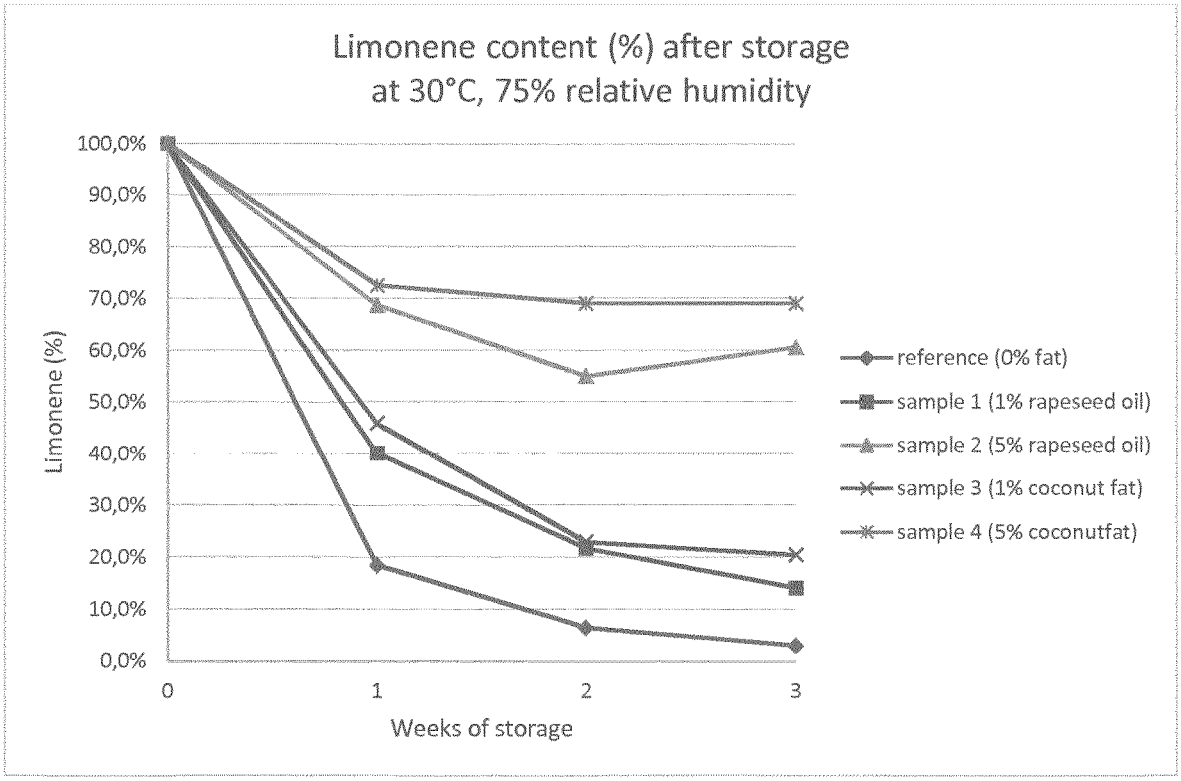
FIG. 1 is a graph showing limonene content (%) after storage at 30° C., 75% relative humidity.

The term "tobacco material" is used herein for fibrous material of tobacco leaves or parts of leaves, such as lamina and stem. The leaves and parts of leaves may be finely divided (disintegrated), such as ground, cut, shredded or threshed, and the parts of leaves may be blended in defined proportions in the tobacco material.

By "tobacco" as used herein is meant any part, e.g., leaves, stems, and stalks, of any member of the genus *Nicotiana*. The tobacco may be whole, shredded, threshed, cut, ground, cured, aged, fermented, or treated otherwise, e.g., granulated or encapsulated.

"Oral" and "oral use" is in all contexts used herein as a description for use in the oral cavity of a human, such as buccal placement.

As used herein, the term "moisture content" refers to the total amount of oven volatile ingredients, such as water and other oven volatiles (e.g. propylene glycol) in the preparation, composition or product referred to. The moisture content is given herein as percent by weight (wt %) of the total weight of the preparation, composition or product referred to.

In this document, the expressions "percent by weight", weight % and wt % are used interchangeably.

Some fibrous materials may exhibit hygroscopic properties. Hygroscopic materials maintain equilibrium moisture content depending on the ambient moisture and temperature.

The moisture content as referred to herein may be determined by using a method based on literature references Federal Register/vol. 74, no. 4/712-719/Wednesday, Jan. 7, 2009/Notices "Total moisture determination" and AOAC (Association of Official Analytical Chemics), Official Methods of Analysis 966.02: "Moisture in Tobacco" (1990), Fifth Edition, K. Helrich (ed). In this method, the moisture content is determined gravimetrically by taking 2.5±0.25 g sample and weighing the sample at ambient conditions, herein defined as being at a temperature of 22° C. and a relative humidity of 60%, before evaporation of moisture and after completion of dehydration. Mettler Toledo's Moisture Analyzer HB43, a balance with halogen heating technology, is used (instead of an oven and a balance as in the mentioned literature references) in the experiments described herein. The sample is heated to 105° C. (instead of 99.5±0.5° C. as in the mentioned literature references). The measurement is stopped when the weight change is less than 1 mg during a 90 seconds time frame. The moisture content as weight percent of the sample is then calculated automatically by the Moisture Analyzer HB43.

"Flavour" or "flavouring agent" is used herein for a substance used to influence the aroma and/or taste of the nicotine product, including, but not limited to, essential oils, single flavour compounds, compounded flavourings, and extracts.

As used herein "% w/w" or "wt %" or "weight %" or "% by weight" refers to the weight percent of the ingredient referred to of the total weight of the preparation, composition or product referred to.

As used herein, reference to "dry weight percent", "% by weight, based on dry weight" and the like refers to the weight percent of the ingredient referred to on the basis of the total weight of the dry ingredients, i.e. all ingredients of the preparation, composition or product referred to excluding the moisture content.

As used herein, reference to "wet weight percent", "% by weight, based on wet weight" and the like refers to the weight percent of the ingredient referred to on the basis of the total weight of the ingredients, i.e. all ingredients of the preparation, composition or product referred to including the moisture content. Thus, "% by weight, based on total weight" as used herein is the same as "% by weight, based on wet weight".

As used herein the terms "pouched nicotine product for oral use" or "oral pouched nicotine product" refer to a portion of nicotine-containing filling material packed in a saliva-permeable pouch material intended for oral use.

As used herein the terms "oral pouched nicotine non-tobacco product" or "oral pouched nicotine product free from tobacco" refer to a portion of nicotine-containing filling material packed in a saliva-permeable pouch material intended for oral use wherein no tobacco is included in said product.

As used herein the term "oral pouched nicotine tobacco product" refers to a portion of nicotine-containing filling material packed in a saliva-permeable pouch material intended for oral use wherein an amount of tobacco material within the range of from about 0.1% to about 10% by weight or from about 0.1% to about 5% by weight, based on the total weight of the filling material, is included in said product.

As used herein, the term "monoglyceride" refers to an ester derived from glycerol and one fatty acid, i.e. a monoester of glycerol and one fatty acid. The monoglyceride may be saturated or unsaturated.

As used herein, the term "diglyceride" refers to an ester derived from glycerol and two fatty acids, said fatty acids being the same or different. The diglyceride may be saturated or unsaturated.

As used herein, the term "triglyceride" refers to an ester derived from glycerol and three fatty acids, said fatty acids being the same or different. The triglyceride may be saturated or unsaturated.

As used herein, the term "non-particulate" refers to a component which is not in the form of particle(s).

As used herein, the term "non-encapsulated" refers to a component that is not enclosed in a capsule.

A particulate encapsulated flavorant is known from US 2010/282267.

For instance, the flavouring agent described herein may be a non-encapsulated non-particulate flavouring agent such as a liquid, an oil or a mixture thereof.

As used herein, the term "particulate non-tobacco material" refers to a non-tobacco material comprising particles. The particles may have an average particle size within the range of from 50 to 500 μm.

The oral pouched nicotine product as disclosed herein is intended for use in the oral cavity, such as by buccal placement (e.g. by placing the pouched product between the upper or lower gum and the lip or cheek), and may therefore be referred to as portion-packed (pouched) product for oral use. The oral pouched nicotine product is sized and configured to fit comfortably and discreetly in a user's mouth between the upper or lower gum and the lip or cheek.

The oral pouched nicotine product as disclosed herein may have an oblong shape, such as a substantially rectangular shape (as seen from above when the product is placed on a planar surface). In such case, the longitudinal direction of the product corresponds to the length of the substantially rectangular product and the transverse direction of the product corresponds to the width of the substantially rectangular product.

The total weight of the oral pouched nicotine product (including filling material and packaging material) may be within the range of from about 0.3 to about 1.5 g.

The pouch of the oral pouched nicotine product may be made of any suitable saliva-permeable (and preferably non-dissolvable) packaging material, such as nonwoven. The packaging material (herein also called pouch material) may be a nonwoven material comprising staple fibres of regenerated cellulose, such as viscose rayon staple fibres, and a binder, such as a polyacrylate.

The packaging material may also comprise additional ingredients, such as flavouring agents and/or colorants.

The oral pouched nicotine product may be packaged in a box, can, canister, cardboard box, bag, stick-pack wrapping, plastic wrapping, paper wrapping, foil wrapping, blister pack or on a tray.

The oral pouched (i.e. portion-packed) nicotine products may be positioned randomly in a container or in a pattern, for instance as described in WO 2012/069505. Alternatively or additionally, each oral pouched nicotine product may be placed in a sachet.

The oral pouched nicotine product as disclosed herein comprises a moist filling material and a saliva-permeable pouch of a packaging material enclosing the moist filling material. The moist filling material comprises a particulate non-tobacco material, a non-encapsulated non-particulate flavouring agent, a nicotine source, a pH adjusting agent, a monoglyceride; and a tobacco material within the range of from about 0% to about 10% by weight, based on the total weight of the moist filling material. The oral pouched nicotine product may be free from tobacco, i.e. an oral pouched nicotine non-tobacco product.

As described herein, the moist filling material may comprise no tobacco material, i.e. it may be free from tobacco material. Alternatively, the moist filling material may comprise a tobacco material within the range of from about 0.1% to about 10% by weight such as from about 0.1% to about 5% by weight, such as from about 0.1% to about 0.5% by weight, such as from 0.1% to about 0.3% by weight, such as about 0.2% by weight, based on the total weight of the moist filling material.

The tobacco material may be a purified tobacco material, such as a bleached tobacco material.

The tobacco material described herein may comprise one, two or more particulate non-tobacco materials.

The tobacco material may be provided as tobacco fibers, ground tobacco and/or as snuff such as snus.

The moist filling material of the oral pouched nicotine product described herein is a filling material which may have a moisture content within the range of from about 10% to about 60% by weight, such as from about 40% to about 60% by weight, such as from about 35% to about 55% by weight, such as about 35% to about 45% by weight, such as about 30% to about 40% by weight, such as from about 50% to about 60% by weight, or such as from above about 50% to about 60% by weight, based on the total weight of the moist filling material.

The moist filling material described herein comprises a monoglyceride. The monoglyceride may be present in an amount from about 0.1% to about 10% by weight—such as from about 0.1% to about 6% by weight, such as from about 0.1% to about 5% by weight, such as from about 0.5% to about 5% by weight, such as from about 0.5% to about 3% by weight, such as from 1% to about 4%, or such as from about 1% to about 3% by weight, such as 0.3% to 3% by weight, based on the total weight of the moist filling material. For instance, the monoglyceride may be present in an amount of about 1%, about 2% or about 3% based on the total weight of the moist filling material. In an example, the monoglyceride may be present in an amount from about 1% to about 2% based on the total weight of the moist filling material.

The monoglyceride may be distilled. Alternatively, the monoglyceride may be non distilled. Further, the monoglyceride may be a combination of distilled and non distilled monoglyceride.

The oral pouched nicotine product as described herein may comprise diglyceride. For example, the oral pouched nicotine product may comprise trace amounts of diglyceride. The diglyceride may be present in the non distilled monoglyceride.

The monoglyceride may be single monoglyceride, such as monoglyceride of sunflower oil. Furthermore, the monoglyceride may be a mixture of different monoglycerides, such as two or more monoglycerides.

The monoglyceride may comprise, consist of and/or originate from one or more of the following: sunflower oil, soybean oil, cottonseed oil, safflower oil, lard, tallow, palm oil, coconut oil, coconut fat, rapeseed oil, cocoa butter, palmolein oil, shea butter, mango kernel oil, corn oil, olive oil, peanut oil, almond oil, jojoba oil, avocado oil, linseed oil, rosehip seed oil, argan oil, sesame oil, macadamia oil, wheat germ oil, broccoli seed oil, grape seed oil, thistle oil, walnut oil, palm kernel oil, cotton seed oil, canola oil, sesame oil, mustard oil, beech nut oil, cashew oil, hazelnut oil, pecan oil, pine nut oil, pistachio oil, grapefruit seed oil, lemon oil, orange oil, pumpkin oil, watermelon seed oil, citrus oils, oils from melons and gourd seeds, flaxseed oil or the like. For instance, the monoglyceride may be prepared by a process involving distillation of one or more of the following: sunflower oil, soybean oil, cottonseed oil, safflower oil, lard, tallow, palm oil, coconut oil, rapeseed oil or the like.

The oral pouched nicotine product may further comprise a triglyceride. The triglyceride may be a single triglyceride. Alternatively, the triglyceride may be a mixture of different triglycerides, such as two or three triglycerides.

The triglyceride of the moist filling material of the oral pouched nicotine product disclosed herein may be present in an amount within the range of from about 0.5% to about 10% by weight, or from about 1.0% to about 5% by weight, based on the total weight of the moist filling material.

The triglyceride may be a vegetable fat or oil selected from the group consisting of cocoa butter, coconut fat or oil, palm oil, palmolein oil, shea butter, mango kernel oil, corn oil, sunflower oil, soybean oil, rapeseed oil, olive oil, peanut oil, almond oil, jojoba oil, avocado oil, linseed oil, rosehip seed oil, argan oil, sesame oil, macadamia oil, wheat germ oil, broccoli seed oil, grape seed oil, thistle oil, walnut oil, palm kernel oil, cotton seed oil, canola oil, sesame oil, mustard oil, beech nut oil, cashew oil, hazelnut oil, pecan oil, pine nut oil, pistachio oil, grapefruit seed oil, lemon oil, orange oil, pumpkin oil, watermelon seed oil, citrus oils, oils from melons and gourd seeds, flaxseed oil, safflower oil, and any combination of the foregoing.

The triglyceride may be a vegetable fat or oil selected from the group consisting of rapeseed oil, sunflower oil, coconut fat or oil, and any combination thereof.

The amount of monoglyceride and triglyceride, in an oral pouched nicotine product comprising both monoglyceride and triglyceride, may be within the range of from about 0.5% to about 10% by weight, such as from about 0.5% to about 6% by weight, such as from about 0.5% to about 3% by weight, based on the total weight of the moist filling material. Further, the monoglyceride and optionally the triglyceride may be dispersed within the moist filling material. For instance, small droplets of monoglyceride and optionally triglyceride may be dispersed within the moist filling material. Further, diglyceride may, when present in the oral pouched nicotine product described herein, be dispersed within the moist filling material.

The monoglyceride and the triglyceride, in an oral pouched nicotine product comprising both monoglyceride and triglyceride, may be present in a ratio of from about 1:1 to about 1:5, in the moist filling material. For instance, the ratio monoglyceride:triglyceride may be 1:1 or 1:5.

The moist filling material may comprise within the range of from about 30% to about 80% by weight of the particulate non-tobacco material, based on total weight of the moist filling material.

The particulate non-tobacco material is preferably water-insoluble.

The particulate non-tobacco material may comprise cellulose such as cellulose selected from the group consisting of microcrystalline cellulose and powdered cellulose.

The particulate non-tobacco material may comprise a combination of cellulose, such as microcrystalline cellulose and/or powdered cellulose, and one or more water-insoluble fibers as described herein.

In particular, the particulate non-tobacco material may comprise or consist of microcrystalline cellulose.

The moist filling material may comprise one, two or more non-encapsulated flavouring agents. As used herein, an encapsulated flavouring agent is a flavouring agent contained within a capsule. Accordingly, a non-encapsulated flavouring agent is not contained within a capsule.

The flavouring agent of the filling material in the oral pouched nicotine product as disclosed herein may be a hydrophobic flavouring agent.

The flavouring agent described herein may be a non-encapsulated non-particulate flavouring agent. For instance, the flavouring agent of the filling material in the oral pouched nicotine product as disclosed herein may be an oil, a liquid or a mixture thereof. Further, the flavouring agent(s) may be in the form of a liquid and/or a solid.

The moist filling material of the oral pouched nicotine product as disclosed herein may comprise within the range of from about 0.5% to about 3.0% by weight of the flavouring agent, based on the total weight of the moist filling material.

The moist filling material may further comprise an encapsulated flavouring agent. The encapsulated flavouring agent may be the same or different from the non-encapsulated flavouring agent. Alternatively, the moist filling material may be free from encapsulated flavouring agent.

The moist filling material may comprise one, two or one, two or more nicotine sources.

The moist filling material of the oral pouched nicotine product described herein may be provided as a powder or granulate. Thus, the moist filling material enclosed by the saliva-permeable pouch of the packaging material may be provided in a non-compressed form.

As used herein, the term "nicotine source" refers to nicotine in any form.

The moist filling material may comprise within the range of from about 1.0% to about 10% by weight of the nicotine source, based on the total weight of the moist filling material.

The nicotine source may be nicotine base, a nicotine salt and/or a nicotine complex such as nicotine bound to an ion exchanger, such as nicotine polacrilex. In particular, the nicotine source may be a nicotine salt.

Nicotine base (oily liquid) may be synthetically produced or extracted from tobacco.

The nicotine source may be a nicotine salt such as a nicotine salt selected from the group consisting of nicotine hydrochloride, nicotine dihydrochloride, nicotine monotartrate, nicotine bitartrate, nicotine bitartrate dihydrate, nicotine sulphate, nicotine zinc chloride monohydrate and nicotine salicylate, and any combination of two or more thereof.

In particular, the filling material may comprise nicotine bitartrate and/or nicotine bitartrate dihydrate.

The amount of nicotine salt per pouched product may be within the range from about 0.1 mg to about 20 mg of nicotine calculated as nicotine base, such as about 0.5, about 1.0, about 1.5, about 2.0, about 2.5, about 3.0, about 3.5, about 4.0, about 4.5, about 5.0, about 6.0, about 7.0, about 8.0, about 9.0, about 10, about 12, about 14, about 16, about 18, or about 20 mg of nicotine.

The nicotine salt of the moist filling material in the oral pouched nicotine product as disclosed herein may be in solid form and/or dissolved form.

The nicotine source as disclosed herein may be adsorbed or non-adsorbed onto the particulate non-tobacco material as disclosed herein. It will be appreciated that the expression "adsorbed onto" means that the nicotine source adheres to an outer surface of the non-tobacco particulate material. Additionally or alternatively, the nicotine source may be absorbed or non-absorbed into any voids or cavities of the non-tobacco particulate material.

When the nicotine source is adsorbed onto the non-tobacco particulate material it adheres to the outer surface of said non-tobacco particulate material without substantially penetrating into any void(s) of said non-tobacco particulate material.

The flavouring agent described herein may be stable at pH>7.

The moist filling material described herein may comprise one, two or more pH adjusting agents.

The moist filling material of the oral pouched nicotine product as disclosed herein may comprise within the range of from about 1.0% to about 15% by weight, based on total weight of the moist filling material, of the pH adjusting agent.

The amount of pH adjusting agent may be selected such that the moist filling material when dispersed in purified water provides a pH above 7.0, such as a pH within the range of from about 7.0 to about 10.0 or a pH within the range of from about 8.0 to about 9.0, such as a pH within the range of from about 8.3 to about 8.7.

The pH of the moist filling material can be measured by adding 100 ml of distilled water to 5.0 gram of moist filling material, for instance in a 100 ml Erlenmeyer flask, stirring the resulting mixture at room temperature with a magnetic stirrer at 100 rpm for about 5 minutes, and then measuring the pH of an extract obtained therefrom with a calibrated (according to the manufacturer's instructions) pH meter. For correctness of readings, the sample solutions shall be analyzed within one hour. In this document, the term "rpm" stands for revolutions per minute. Further, in this document the expression "room temperature" stands for from about 20° C. to about 25° C. such as about 22° C.

Examples of suitable pH adjusting agents are sodium carbonate, sodium hydroxide, potassium hydroxide, potassium carbonate, sodium carbonate, sodium bicarbonate and magnesium carbonate. These pH adjusting agents may be used alone or in combination of two or more thereof.

In particular, the pH adjusting agent may be potassium hydroxide.

The moist filling material described herein may further comprise water-insoluble fibers selected from the group consisting of maize fibers, oat fibers, tomato fibers, barley fibers, rye fibers, sugar beet fibers, buck wheat fibers, wheat fibers, pea fibers, potato fibers, apple fibers, cocoa fibers, bamboo fibers, citrus fibers, and any combination thereof. The water-insoluble fibers may be mixed with the moist filling material components and/or form part of the particulate non-tobacco material. In an example, the particulate non-tobacco material may comprise water-insoluble fibers selected from the group consisting of maize fibers, oat fibers, tomato fibers, barley fibers, rye fibers, sugar beet fibers, buck wheat fibers, wheat fibers, pea fibers, potato fibers, apple fibers, cocoa fibers, bamboo fibers, citrus fibers, and any combination thereof.

Moreover, the particulate non-tobacco material, the non-encapsulated flavouring agent, the nicotine source, the pH adjusting agent, the monoglyceride, optionally the diglyceride, optionally the triglyceride and optionally the tobacco material may be homogeneously mixed, i.e. provided as a uniform mixture. Thus, there is provided an oral pouched nicotine product as described herein wherein the moist filling material components are substantially homogenously mixed.

Examples of flavours include bergamot, eucalyptus, orange, mandarin, citrus, lemon, peppermint, spearmint, mint, menthol, liquorice, wintergreen, whiskey, rum, cherry, various berries, tobacco, coffee, vanilla, lime, apple, peach, carvone, limonene and any combination of two or more thereof. These flavours may be used as a flavouring agent in the present disclosure.

The moist filling material described herein may be devoid of surfactants and/or emulsifiers other than the monoglyceride mentioned herein. In another example, the moist filling material may be devoid of surfactants and/or emulsifiers other than the monoglyceride, the diglyceride and/or the triglyceride mentioned herein.

The moist filling material of the oral pouched nicotine product as disclosed herein may also comprise a salt selected from the group consisting of sodium chloride, potassium chloride, magnesium chloride, calcium chloride and any combination of two or more thereof.

The moist filling material of the oral pouched nicotine product as disclosed herein may comprise within the range of from about 1.0% to about 10% w/w, based on the total weight of the moist filling material, of a salt as described herein such as sodium chloride.

Sodium chloride is generally used for its effect on taste but it also has a preservative action which contributes to improved shelf life of the product. Salt, such as sodium chloride, lowers the water activity of the products, thus preventing microorganisms from growing, which leads to e.g. an improved shelf-life of the products.

The oral pouched nicotine product described herein may comprise no anatabine.

For instance, the oral pouched nicotine product described herein may be free from tobacco material, i.e. comprises 0 wt % of tobacco material, and comprise no anatabine.

Anatabine is one of the minor alkaloids found in plants in the Solanaceae family, which inter alia includes the tobacco plant. The oral pouched nicotine non-tobacco product described herein may be free from tobacco, i.e. may contain 0 wt % of tobacco material, and also free from anatabine. Alternatively, the oral pouched nicotine non-tobacco product described herein may contain a small amount of tobacco, such as from about 0.1% to about 10% by weight as described herein, and may then not comprise anatabine in addition to the anatabine present in said tobacco material.

The oral pouched nicotine non-tobacco product described herein may be devoid of anatabine. Further, the oral pouched nicotine product as described herein may contain tobacco containing anatabine but without any added anatabine.

There is also provided a use of monoglyceride as described herein for flavour preservation, prevention of pouch seal weakening and/or improved shelf life stability in and/or of an oral pouched nicotine product such as an oral pouched non-tobacco nicotine product and/or such as an oral pouched low tobacco nicotine product. The oral pouched non-tobacco nicotine product may be as described herein. The oral pouched low tobacco nicotine product may comprise tobacco material in an amount within the range of from about 0.1% to about 10% by weight, such as from about 0.1% to about 5% by weight, such as from about 0.1% to about 0.5% by weight, based on the total weight of said product including or excluding the weight of the pouch material. The oral pouched low tobacco nicotine product may be an oral pouched nicotine product comprising tobacco as described herein. In particular, the oral pouched nicotine product described herein shows improved pouch seal strength for seals made by heat sealing such as heat sealing of pouches made from regenerated cellulose. The pouch seal may comprise a chemical binder such as acrylate. The shelf life stability may be improved at room temperature.

Further, there is also provided a use of a combination of monoglyceride, triglyceride and optionally diglyceride as described herein for flavour preservation, prevention of pouch seal weakening and/or improved shelf life stability in and/or of an oral pouched nicotine product such as an oral pouched non-tobacco nicotine product and/or such as an oral pouched low tobacco nicotine product. The oral pouched non-tobacco nicotine product may be as described herein. The oral pouched low tobacco nicotine product may comprise tobacco material in an amount within the range of from about 0.1% to about 10% by weight, such as from about 0.1% to about 5% by weight, such as from about 0.1% to about 0.5% by weight, based on the total weight of said product including or excluding the weight of the pouch material. The oral pouched low tobacco nicotine product may be an oral pouched nicotine product comprising tobacco as described herein. product as disclosed herein. The shelf life stability may be improved at room temperature, i.e. about 20° C.

The moist filling material as disclosed herein may be manufactured using a method comprising:

- providing a mixture comprising a particulate non-tobacco material and a nicotine source such as a nicotine salt,
- adding monoglyceride, optionally diglyceride and optionally triglyceride to the mixture comprising a particulate non-tobacco material and nicotine source thereby providing a mixture comprising particulate non-tobacco material, nicotine source, monoglyceride and optionally triglyceride,
- adding water to the mixture comprising non-tobacco material, nicotine source such as nicotine salt, monoglyceride, optionally diglyceride and optionally triglyceride,
  - wherein a pH adjusting agent is added in and/or after any of the foregoing steps, a non-encapsulated flavouring agent is added in and/or after any of the foregoing steps, and optionally a tobacco material is added in and/or after any of the foregoing steps.

The method may also comprise a step of enclosing the moist filling material in a saliva-permeable pouch of a packaging material thereby providing an oral pouched nicotine product as disclosed herein.

Thus, there is provided a method for manufacturing an oral pouched nicotine product, said method comprising the steps:

- providing a mixture comprising a particulate non-tobacco material and a nicotine source,
- adding monoglyceride, optionally diglyceride and optionally triglyceride to the mixture comprising a particulate non-tobacco material and nicotine source thereby providing a mixture comprising particulate non-tobacco material, nicotine source, monoglyceride and optionally triglyceride,
- adding water to the mixture comprising non-tobacco material, nicotine source such as nicotine salt, monoglyceride, optionally diglyceride and optionally triglyceride,
- wherein a pH adjusting agent is added in and/or after any of the foregoing steps, a non-encapsulated flavouring agent is added in and/or after any of the foregoing steps, and optionally a tobacco material is added in and/or after any of the foregoing steps, thereby providing a moist filling material; and
- enclosing the moist filling material in a saliva-permeable pouch of a packaging material thereby providing an oral pouched nicotine product.

It will be appreciated that the step of enclosing the moist filling material in a saliva-permeable pouch may take place by measuring portions of the moist filling material and inserting the portions into a nonwoven tube.

For instance, the oral pouched nicotine products described herein may be produced as described in U.S. Pat. No. 4,703,765 or as described in EP 2428450 B1, which are herein incorporated by reference. Albeit U.S. Pat. No. 4,703,765 and EP 2428450 B1 concern tobacco products, it will be appreciated that their teachings are also applicable to oral pouched nicotine products as described herein. U.S. Pat. No.

4,703,765 discloses a device for packaging precise amounts of finely divided tobacco products, such as snuff tobacco or the like, in a tubular packaging material into which snuff portions are injected via a fill tube. Downstream from the tube, welding means are positioned for transverse sealing of the packaging material, and also cutting means for severing the packaging material in the area of the transverse seal to thus form discrete or individual portion packages. EP 2428450 B1 relates to a snus dosing method, wherein a portion of tobacco is filled into a dosing chamber of a dosing device and then blown out of the dosing chamber by means of blow-out air to which water vapor has been added.

In a further example, the oral pouched nicotine products described herein may be produced by placing portions of moist filling material on a nonwoven web using a pouch packer machine in accordance with the device disclosed in U.S. Pat. No. 6,135,120. It will be appreciated that this device may also be used for the moist filling material described herein instead of tobacco material. The device in U.S. Pat. No. 6,135,120 comprises feeding means for feeding the tobacco material into pockets formed in a rotary portioning wheel for portioning the material into portions, at least one compression means for compressing the tobacco material portions, a unit for advancing a packaging material, such as a nonwoven web, in synchrony with the compressed portions, at least one discharge means for discharging the portions from the pockets to the packaging material, and a forming unit for forming individual portion packages (i.e. pouched smokeless tobacco products) from the discharged portions and the packaging material. At the intended point of discharge of the portions to the packaging material, said packaging material has the form of a tape, the compression means being arranged to compress the portions in a direction which differs from the discharging and the feeding directions. The compression is preferably effected in a direction perpendicular to the discharging and the feeding directions. The compression may be effected in the axial direction of the portioning wheel whereas the feeding and discharging may be effected in the radial direction of said wheel. This technique is herein referred to as the "NYPS" technique.

The individual portions are sealed and cut apart thereby forming rectangular "pillow shaped" (or any other desired form) pouched products. Generally, each final pouched product includes parallel transverse seams at opposite ends and a longitudinal seam orthogonal to the transverse seams. The seals must be of sufficient strength to preserve the integrity of the pouched product during use while not disturbing the consumer's experience.

The oral pouched products described herein are normally sized and configured to fit comfortably and discreetly in a user's mouth between the upper and lower gum and the lip.

In the method(s) described herein, the non-encapsulated flavouring agent such as the non-encapsulated non-particulate flavouring agent as described herein may be added after all other components have been mixed.

There is also provided a moist filling material as described herein which is obtainable by a method as described herein.

There is also provided an oral pouched nicotine product as described herein which is obtainable by a method as described herein.

The mixture of particulate non-tobacco material and a nicotine source in the method described herein may be a dry mixture.

EXAMPLES

In the following examples, the rapeseed oil was provided by Bressmer & Francke, Germany and the coconut oil was provided by Rene Voltaire, Sweden. The monoglyceride used was distilled monoglyceride from sunflower oil, said monoglyceride being provided as the product Dimodan® from Danisco, Denmark. The tobacco product Catch spearmint was purchased from Swedish Match, Sweden, and had a moisture content of 56%. The tobacco product General Classic white was purchased from Swedish Match, Sweden and had a moisture content of 56%.

Example 1

This is a comparative example in which triglyceride was used.

TABLE 1

| | Amount and percentage based on wet weight of composition | | | |
|---|---|---|---|---|
| Ingredient | Sample 1 | | Sample 2 | |
| Microcrystalline cellulose (MCC) | 196.65 g | 39% | 196.65 g | 39% |
| Sodium chloride (NaCl) | 17.5 g | 3.5% | 17.5 g | 3.5% |
| Nicotine bitartrate dihydrate | 15.35 g | 3.0% | 15.35 g | 3.0% |
| Potassium hydroxide (KOH) | 7.75 g | 1.5% | 7.75 g | 1.5% |
| Water | 257.75 g | 51% | 237.75 g | 47% |
| Rapeseed oil | 5.0 g | 1.0% | 25 g | 5.0% |
| Flavour (containing limonene and linalyl acetate) | 4.95 g | 1.0% | 4.95 g | 1.0% |

TABLE 2

| | Amount and percentage based on wet weight of composition | | | | | |
|---|---|---|---|---|---|---|
| Ingredient | Sample 3 | | Sample 4 | | Reference | |
| Microcrystalline cellulose (MCC) | 196.65 g | 39% | 196.65 g | 39% | 195.65 g | 39% |
| Sodium chloride (NaCl) | 17.5 g | 3.5% | 17.5 g | 3.5% | 17.5 g | 3.5% |
| Nicotine bitartrate dihydrate | 15.35 g | 3.0% | 15.35 g | 3.0% | 15.35 g | 3.0% |
| Potassium hydroxide | 7.75 g | 1.5% | 7.75 g | 1.5% | 7.75 g | 1.5% |

TABLE 2-continued

| Ingredient | Amount and percentage based on wet weight of composition | | | | | |
|---|---|---|---|---|---|---|
| | Sample 3 | | Sample 4 | | Reference | |
| Water | 257.75 g | 51% | 237.75 g | 47% | 262.75 g | 52% |
| Coconut fat | 5.0 g | 1.0% | 25 g | 5.0% | — | — |
| Flavour (containing limonene and linalyl acetate) | 4.95 g | 1.0% | 4.95 g | 1.0% | 4.95 g | 1.0% |

In samples 1-4, the dry ingredients MCC, NaCl and nicotine bitartrate were mixed with the fat or oil in a Kenwood mixer (Major Titanium) at minimum speed for 2 minutes.

For samples 1 and 3, 15.5 g of an aqueous 50% w/w KOH solution was added to 250 g (250 ml) water in a container and stirred. The resulting aqueous KOH solution was then added to the dry ingredients during mixing for 5 minutes at speed 1.

For samples 2 and 4, 15.5 g of an aqueous 50% w/w KOH solution was added to 230 g (230 ml) water in a container and stirred. The resulting aqueous KOH solution was then added to the dry ingredients during mixing for 5 minutes at speed 1.

For the reference sample, 15.5 g of an aqueous 50% w/w KOH solution was added to 255 g (255 ml) water in a container and stirred. The resulting aqueous KOH solution was then added to the dry ingredients during mixing for 5 minutes at speed 1.

The flavour was thereafter added to the mixture and the final composition was mixed 4 minutes at minimum speed. The resulting compositions were analyzed with regard to nicotine content (only reference, Sample 3 and Sample 4 were analysed) and flavour content directly after manufacturing and after 1, 2 and 3 weeks of storage at 30° C., 75% relative humidity. Flavor components limonene and linalyl acetate were used as markers for flavor.

Samples were extracted with a liquid-liquid extraction method (further described in the below), which enables simultaneous extraction of both nicotine and flavor compounds. Extracts were analyzed with a GC/MS instrument. Quantification was done using an eight-point standard curve. The method has been verified for different matrices and the recoveries of analytes are better than 95%.

For each replicate 0.5±0.1 g of material was put into an extraction vial. 4 ml of 3 M NaOH was added. The samples were shaken for 5 minutes at ambient temperature (360 rpm). Thereafter 10 ml of methyl tertiary butyl ether and internal standard were added. Samples were shaken for 60 minutes at 50° C. (360 rpm). After cooling for one hour, the organic extracts were transferred to GC-vials and analyzed with GC/MS. Measuring ions for nicotine, limonene and linalyl acetate were 84, 68 and 93 m/z.

Figure 2:
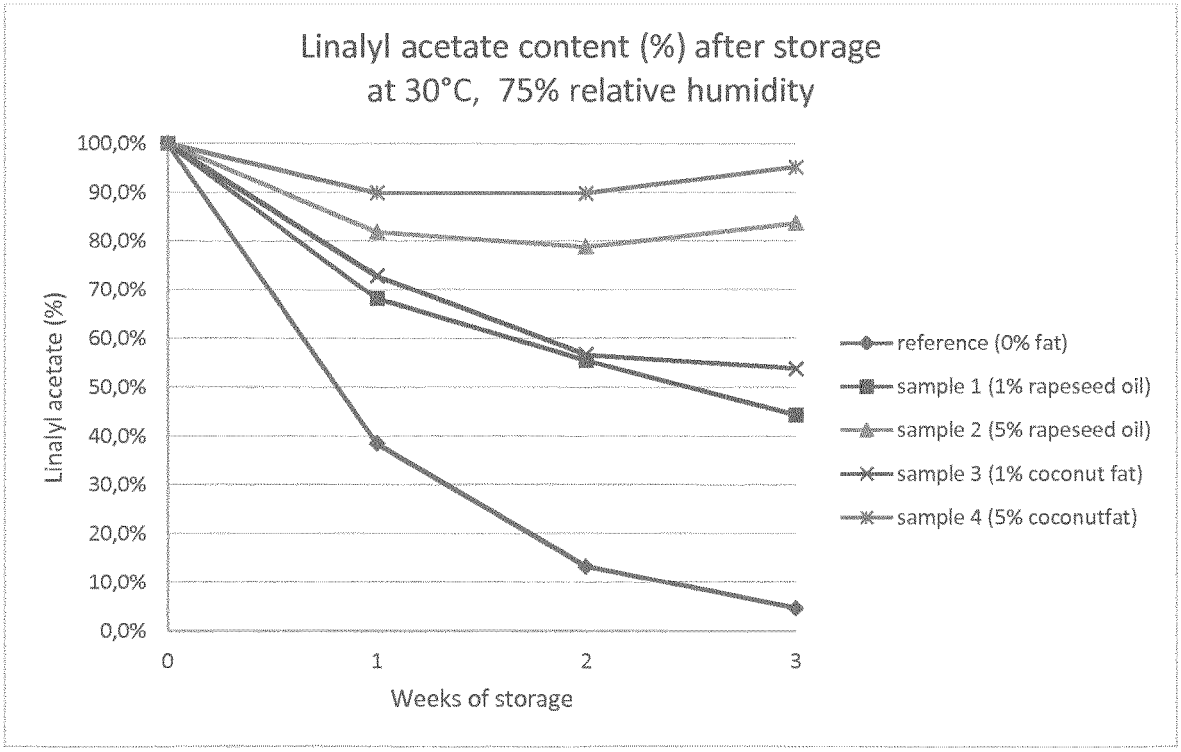
FIG. 2 is a graph showing linalyl acetate content (%) after storage at 30° C., 75% relative humidity.
Figure 3:
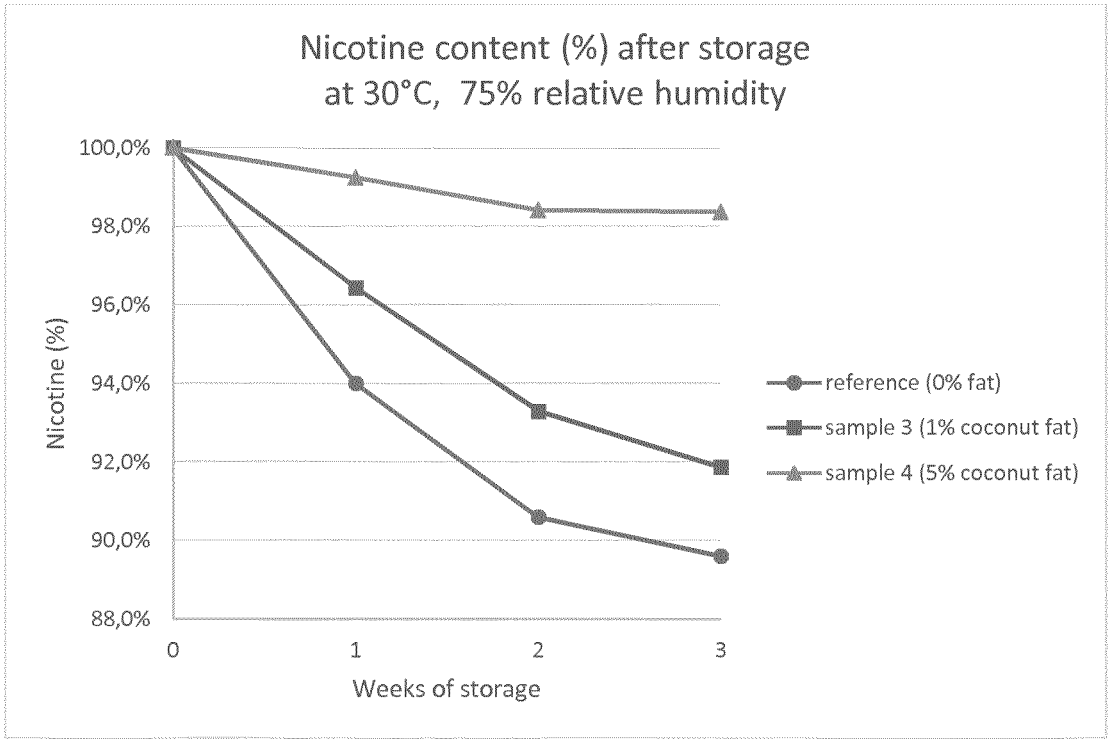
FIG. 3 is a graph showing nicotine content (%) after storage at 30° C., 75% relative humidity.

The results are presented in Tables 3a-5b below and in FIGS. 1-3. Each measured value is the average value of three analyzed samples.

TABLE 3a

| Storage (weeks) | limonene (mg/g) | | | | |
|---|---|---|---|---|---|
| | 0% fat/oil | 1% coconut fat | 5% coconut fat | 1% rape-seed oil | 5% rape-seed oil |
| 0 | 1.65 | 2.22 | 2.81 | 2.23 | 2.91 |
| 1 | 0.30 | 1.02 | 2.04 | 0.90 | 2.00 |
| 2 | 0.10 | 0.51 | 1.94 | 0.48 | 1.60 |
| 3 | 0.05 | 0.45 | 1.94 | 0.31 | 1.76 |

TABLE 3b

| Storage (weeks) | limonene (%) | | | | |
|---|---|---|---|---|---|
| | 0% fat/oil | 1% coconut fat | 5% coconut fat | 1% rape-seed oil | 5% rape-seed oil |
| 0 | 100% | 100% | 100% | 100% | 100% |
| 1 | 18% | 46% | 73% | 40% | 69% |
| 2 | 6% | 23% | 69% | 22% | 55% |
| 3 | 3% | 20% | 69% | 14% | 61% |

TABLE 4a

| Storage (weeks) | linalyl acetate (mg/g) | | | | |
|---|---|---|---|---|---|
| | 0% fat/oil | 1% coconut fat | 5% coconut fat | 1% rape-seed oil | 5% rape-seed oil |
| 0 | 3.40 | 3.83 | 4.01 | 3.65 | 4.11 |
| 1 | 1.31 | 2.79 | 3.60 | 2.48 | 3.37 |
| 2 | 0.45 | 2.17 | 3.60 | 2.02 | 3.24 |
| 3 | 0.16 | 2.06 | 3.81 | 1.62 | 3.44 |

TABLE 4b

| Storage (weeks) | linalyl acetate (%) | | | | |
|---|---|---|---|---|---|
| | 0% fat/oil | 1% coconut fat | 5% coconut fat | 1% rape-seed oil | 5% rape-seed oil |
| 0 | 100% | 100% | 100% | 100% | 100% |
| 1 | 38% | 73% | 90% | 68% | 82% |
| 2 | 13% | 57% | 90% | 55% | 79% |
| 3 | 5% | 54% | 95% | 44% | 84% |

TABLE 5a

| Storage (weeks) | nicotine (mg/g) | | |
|---|---|---|---|
| | 0% fat/oil | 1% coconut fat | 5% coconut fat |
| 0 | 10.00 | 10.08 | 9.63 |
| 1 | 9.40 | 9.72 | 9.56 |
| 2 | 9.06 | 9.41 | 9.48 |
| 3 | 8.96 | 9.26 | 9.48 |

TABLE 5b

| | nicotine (%) | | |
|---|---|---|---|
| Storage (weeks) | 0% fat | 1% coconut fat | 5% coconut fat |
| 0 | 100% | 100% | 100% |
| 1 | 94% | 96% | 99% |
| 2 | 91% | 93% | 98% |
| 3 | 90% | 92% | 98% |

Example 2

This is a comparative example in which triglyceride was used.

TABLE 6

| | Amount and percentage based on wet weight ofcomposition | | | |
|---|---|---|---|---|
| Ingredient | Sample 5 | | Reference | |
| Microcrystalline cellulose (MCC) | 393.3 g | 39% | 393.3 g | 39% |
| Sodium chloride (NaCl) | 35 g | 3.5% | 35 g | 3.5% |
| Nicotine bitartrate dihydrate | 30.7 g | 3.0% | 30.7 g | 3.0% |
| Potassium hydroxide (KOH) | 15.5 g | 1.5% | 15.5 g | 1.5% |
| Water | 425.5 g | 42% | 525.5 g | 52% |
| Rapeseed oil | 100 g | 10.0% | — | — |
| Flavour (containing limonene and linalyl acetate) | 9.9 g | 1.0% | 9.9 g | 1.0% |

The dry ingredients MCC, NaCl and nicotine bitartrate of Sample 5 were mixed with the oil in a Kenwood mixer (Major Titanium) at minimum speed for 2 minutes.

31 g of an aqueous 50% w/w KOH solution was added to 410 g (410 ml) water in a container and stirred. The resulting aqueous KOH solution was then added to the dry ingredients during mixing for 5 minutes at speed 1.

For the reference sample, 31 g of an aqueous 50% w/w KOH solution was added to 510 g (510 ml) water in a container and stirred. The resulting aqueous KOH solution was then added to the dry ingredients during mixing for 5 minutes at speed 1.

The flavour was thereafter added to the mixture and the final composition was mixed 4 minutes at minimum speed.

Each of the Sample 5 composition and the reference composition was thereafter portion-packed in a semi-permeable packaging material of nonwoven using heat-melt welding thereby providing oral pouched products.

The pouched products were also analyzed with regard to pouch seal strength using the following method.

After 10 days storage at room temperature, the samples were prepared by cutting the pouches to a specified width (specified below) and opening the pouch so that one seal is left with two plies. The strength of the seal was then tested using an Instron 5943. One ply is attached to the upper gauge and one ply to the lower gauge. The force used to peel apart the seal was determined and expressed as load per width at maximum load. The following machine parameters were used:

load range: 50 N
extension: 10 mm
gauge length: 13 mm
speed: 10 mm/min
preload: 0.1 N
sample width: 12 mm The results are presented in Table 7 below. Each measured value is the average value of twelve analyzed samples.

TABLE 7

| | Peel strength (N/mm) |
|---|---|
| Sample 5 | 0.077 |
| Reference | 0.053 |

Sample 5 was found to have improved seal strength in comparison to the reference.

Example 3

In this example a combination of monoglyceride and triglyceride was used. It was compared with a composition comprising triglyceride.

A wet composition (moisture content 35%-40% by weight based on the total weight of the composition) comprising microcrystalline cellulose, sodium chloride, nicotine bitartrate, potassium hydroxide, water, monoglyceride and optionally triglyceride and flavor comprising peppermint was prepared using the method described herein. The resulting wet composition was thereafter portion-packed in a semi-permeable packaging material of nonwoven using heat-melt welding thereby providing oral pouched products. The oral pouched products were analyzed with regard to pouch seal strength using the method described herein.

Two experiments were performed in which the rapeseed oil and the monoglyceride were added in the following amounts based on the wet composition:

(i) 5 wt % of rapeseed oil and 1 wt % of monoglyceride (ii) 5 wt % of rapeseed oil and 0 wt % of monoglyceride More specifically, the composition was as specified in Table A below which also shows a composition in which triglyceride was used. The compositions in Table A were produced by mixing the dry ingredients cellulose, taste enhancer, nicotine and tobacco for 3 minutes. Thereafter, the wet ingredients potassium hydroxide solution and humectants were added during mixing and then the rape seed oil, flavor and, if applicable, the monoglyceride were added. The total wet granulation time was less than 10 min. The resulting wet composition were thereafter portion-packed in a semi-permeable packaging material of nonwoven using heat-melt welding thereby providing oral pouched products.

TABLE A

| | Amount and percentage based on wet weight ofcomposition | | | |
|---|---|---|---|---|
| Ingredient | Sample with 5% rape seed oil | | Sample with 5% rape seedoil and 1% monoglyceride | |
| Cellulose | 16.3 kg | 40.48% | 16.8 kg | 41.72% |
| Taste enhancer | 1.433 kg | 3.56% | 1.433 kg | 3.56% |
| Nicotine and tobacco | 2.58 kg | 6.41% | 2.58 kg | 6.41% |
| Potassium hydroxide solution (50% water) | 2.16 kg | 5.36% | 2.16 kg | 5.36% |
| Water and humectants | 15.19 kg | 37.73% | 14.3 kg | 35.51% |

TABLE A-continued

| Ingredient | Amount and percentage based on wet weight ofcomposition | | | |
|---|---|---|---|---|
| | Sample with 5% rape seed oil | | Sample with 5% rape seedoil and 1% monoglyceride | |
| Rapeseed oil | 2 kg | 4.97% | 2 kg | 4.97% |
| Monoglyceride | — | — | 0.4 kg | 0.99% |
| Flavour (containing peppermint) | 0.6 kg | 1.49% | 0.6 kg | 1.49% |

Figure 4:
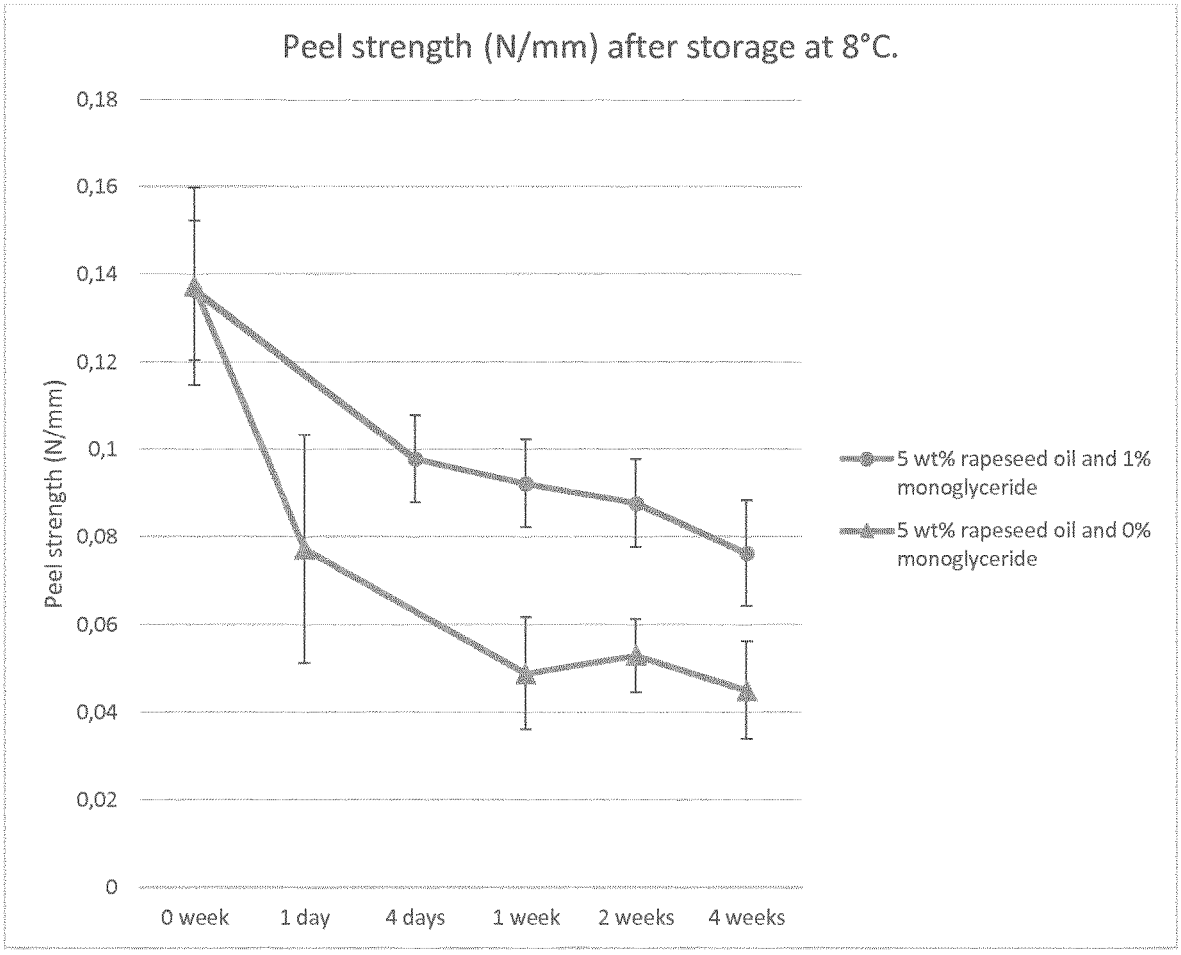
FIG. 4 is a graph showing peel strength (N/mm) after storage at 8° C.

The pouch seal strength was measured during storage for four weeks at 8° C. in a refrigerator. It was found that the pouch seal strength was considerably improved for experiment (i) as compared to experiment (ii) The results are shown in FIG. 4. From FIG. 4 it is clear that the peel strength is higher for experiment (i) as compared to experiment (ii). It was concluded that addition of a combination of triglyceride and monoglyceride increased the pouch seal strength.

Example 4

In this example monoglyceride was used optionally in combination with triglyceride.

In this example, the distribution of the flavour in the pouch material and the moist filling material of the pouched nicotine product was measured. Further, flavour stability and pouch seal strength were measured.

A wet composition (moisture content 35%-40% by weight based on the total weight of the composition) comprising microcrystalline cellulose, sodium chloride, nicotine bitartrate, potassium hydroxide, water, monoglyceride, optionally triglyceride, and flavour was prepared as described below.

The following wet compositions containing a flavor mixture comprising carvone were produced:

TABLE 8a

| Ingredient | Sample 1 | Sample 2 | Sample 3 | Sample 4 | Sample 5 | Sample 6 |
|---|---|---|---|---|---|---|
| Cellulose | 40.77% | 40.77% | 40.77% | 40.77% | 40.77% | 41.77% |
| Taste enhancer | 3.79% | 3.79% | 3.79% | 3.79% | 3.79% | 3.79% |
| Nicotine and tobacco | 3.9% | 3.9% | 3.9% | 3.9% | 3.9% | 3.9% |
| Potassium hydroxide solution (50% water) | 3.4% | 3.4% | 3.4% | 3.4% | 3.4% | 3.41% |
| Water and humectants | 47.13% | 46.13% | 45.13% | 45.13% | 43.13% | 39.87% |
| Triglyceride | 0 | 0 | 0 | 1% | 0 | 4.93% |
| Monoglyceride | 0 | 1% | 2% | 1% | 4% | 0.98% |
| Flavour (comprising carvone) | 1.02% | 1.02% | 1.02% | 1.02% | 1.02% | 1.36% |

Further, the following wet compositions containing a flavor mixture comprising limonene were produced:

TABLE 8b

| Ingredient | Sample 7 | Sample 8 | Sample 9 |
|---|---|---|---|
| Cellulose | 41.77% | 41.77% | 41.77% |
| Taste enhancer | 3.79% | 3.79% | 3.79% |
| Nicotine and tobacco | 3.9% | 3.9% | 3.9% |
| Potassium hydroxide solution (50% water) | 3.4% | 3.4% | 3.4% |
| Water and humectants | 45.98% | 44.98% | 39.37% |
| Triglyceride | 0 | 0 | 4.96% |
| Monoglyceride | 0 | 0.99% | 0.99% |
| Flavour (comprising limonene) | 1.85% | 1.85% | 1.85% |

In Table 8a and Table 8b the percentage intends weight percentage based on the total weight of the composition.

The oral pouched products were thereafter stored at 22° C. for 16 days (samples 1-6) and at 22° C. for 21 days (samples 7-9).

Figure 5:
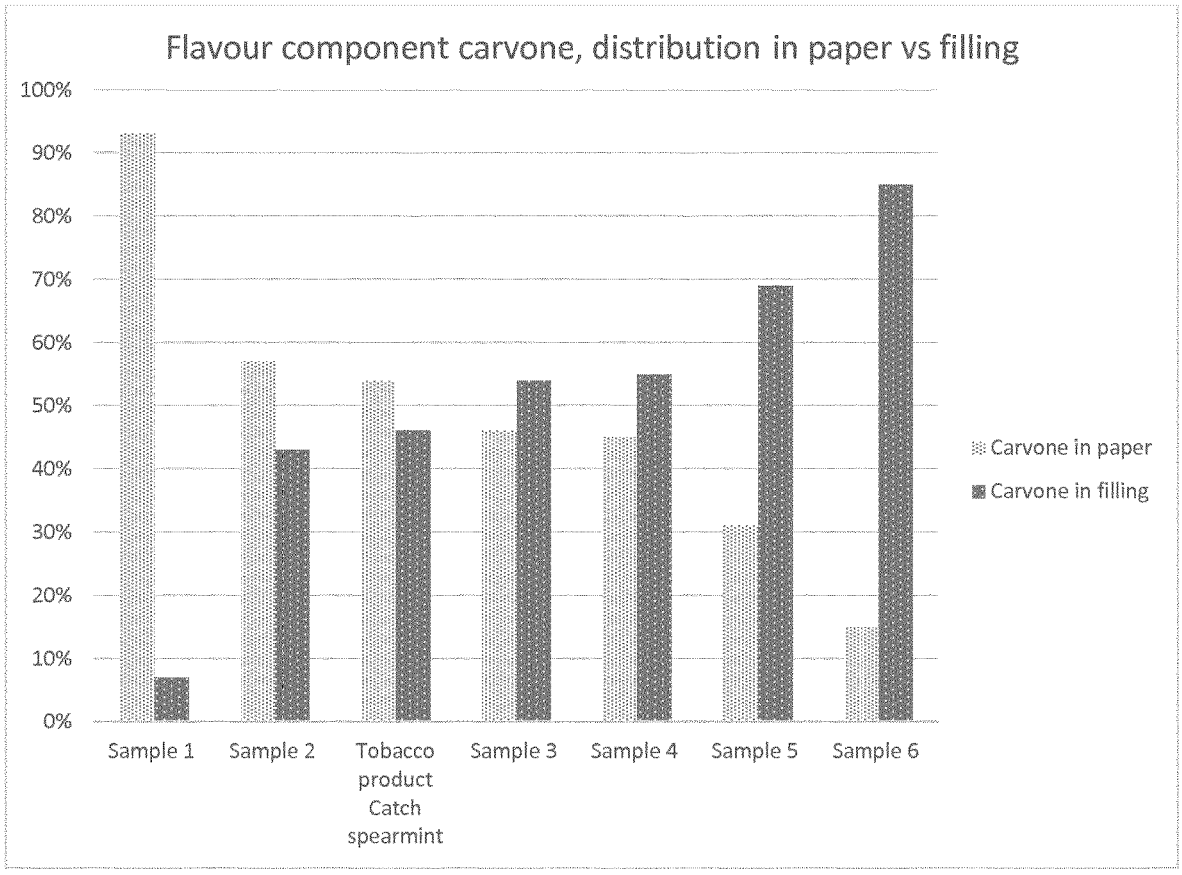
FIG. 5 is a bar graph showing flavour component carvone, distribution in paper vs. filling.
Figure 6:
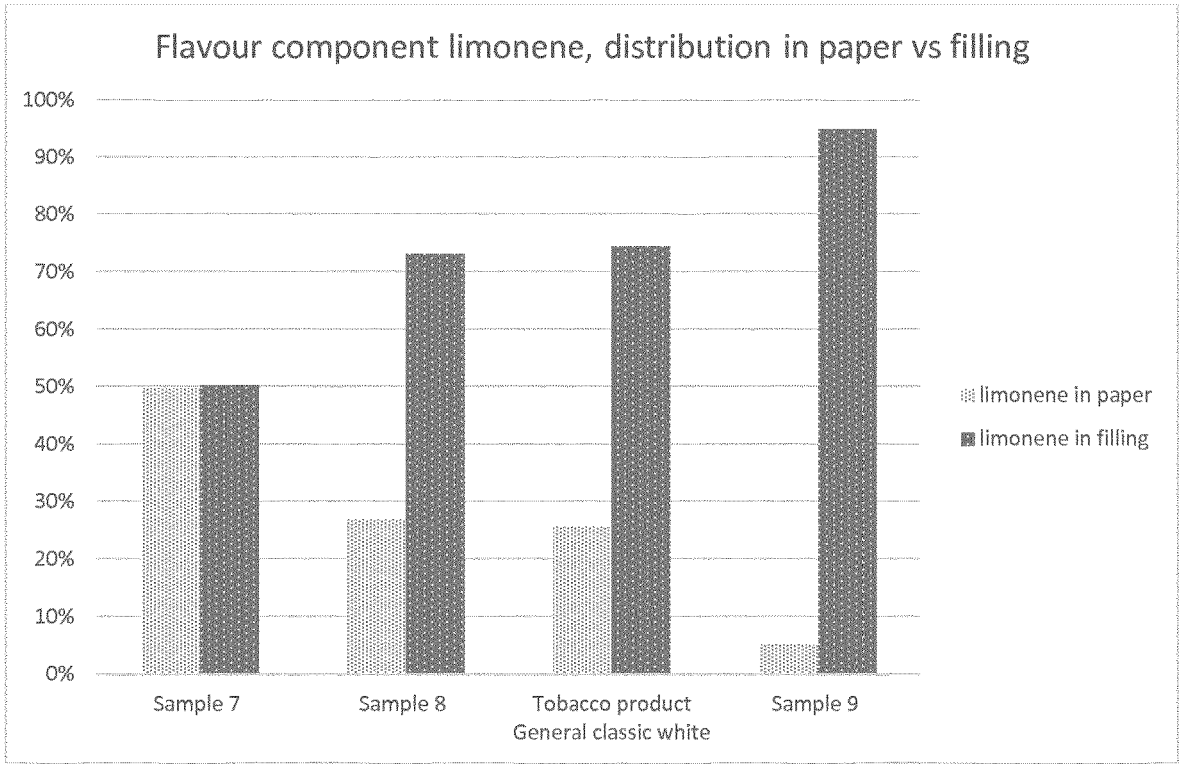
FIG. 6 is a bar graph showing flavour component limonene, distribution in paper vs. filling.

The weight of each oral pouched products was noted. The paper was separated from the filling and placed in different vials with each respective weight noted. 4 ml of 3 M NaOH was added to each extraction vial. The samples were shaken for 5 minutes at ambient temperature (360 rpm). Thereafter 10 ml of methyl tertiary butyl ether and internal standard were added. Samples were shaken for 60 minutes at 50° C. (360 rpm). After cooling for one hour, the organic extracts were transferred to GC-vials and analyzed with GC/MS. The result is shown in Tables 9, 10 and 11 below. The results in Table 9 are shown in FIG. 5. The results in Table 10 are shown in FIG. 6.

TABLE 9

| Carvone | Carvone in pouch material | Carvone in moist filling material |
|---|---|---|
| Sample 1 | 93% | 7% |
| Sample 2 | 57% | 43% |
| Tobacco product Catch spearmint | 54% | 46% |
| Sample 3 | 46% | 54% |
| Sample 4 | 45% | 55% |
| Sample 5 | 31% | 69% |
| Sample 6 | 15% | 85% |

TABLE 10

| Limonene | Limonene in pouch material | Limonene in moist filling material |
|---|---|---|
| Sample 7 | 50% | 50% |
| Sample 8 | 27% | 73% |
| Tobacco product General classic white | 26% | 74% |
| Sample 9 | 5% | 95% |

From Table 9 and FIG. 5 it was observed that the presence of monoglyceride led to improved retention of the flavour in the moist filling material. This was also observed for a combination of monoglyceride and triglyceride. It was also observed that monoglyceride present in an amount of 1 wt % (sample 2) had a similar flavour distribution as the smokeless tobacco product Catch spearmint from Swedish Match, Sweden.

From Table 10 and FIG. 6 it was observed that the presence of monoglyceride led to improved retention of the flavour in the moist filling material. This was also observed for a combination of monoglyceride and triglyceride. It was also observed that monoglyceride present in an amount of 1 wt % (sample 8) had a similar flavour distribution as the smokeless tobacco product General classic white from Swedish Match, Sweden.

The stability of the flavour in the pouched moist filling material of samples 1, 2, 3 and 4 in Table 8 was measured. Each sample initially contained 13.6 mg/g of flavour. After storage for 16 days at 22° C. the amount of remaining flavour in the moist filling material was found to be as shown in Table 11.

TABLE 11

| Sample | Measured amount carvone after 16 days (mg/g) |
|---|---|
| Sample 1 | 2.55 |
| Sample 2 | 3.1 |
| Sample 3 | 3.59 |
| Sample 4 | 3.63 |

It was observed that the amount of flavour decreased less in the presence of monoglyceride (sample 2 and 3) or in the presence of a combination of monoglyceride and triglyceride (sample 4) as compared to a sample lacking monoglyceride and triglyceride (sample 1).

The stability of the flavour in the filling material of the pouched nicotine product in samples 7, 8 and 9 in Table 8b was measured. Each sample initially contained 18.0 mg/g of flavour. After storage for 21 days at 22° C. the amount of remaining flavour in the moist filling material was found to be as shown in Table 12.

TABLE 12

| Sample | Measured amount limonene after 21 days (mg/g) |
|---|---|
| Sample 7 | 0.52 |
| Sample 8 | 1.26 |
| Sample 9 | 3.93 |

It was observed that the amount of flavour decreased less in the presence of monoglyceride (sample 8) or in the presence of a combination of monoglyceride and triglyceride (sample 9) as compared to a sample lacking monoglyceride and triglyceride (sample 7).

The peel strength was measured for sample 1 and sample 2 which had been stored at 8° C. for four days. The measurement was performed as described in Example 2 herein. The results are shown in Table 13.

TABLE 13

| Sample | Peel strength (N/mm) |
|---|---|
| Sample 1 | 0.0658 |
| Sample 2 | 0.1214 |

It was concluded that the presence of monoglyceride increased the pouch seal strength (sample 2) as compared to a corresponding sample lacking monoglyceride (sample 1).

The invention claimed is:

1. An oral pouched nicotine product comprising a moist filling material and a saliva-permeable pouch of a packaging material enclosing the moist filling material, the moist filling material comprising:

a particulate non-tobacco material;

a non-encapsulated non-particulate flavouring agent;

a nicotine source;

a pH adjusting agent; and a monoglyceride, wherein the monoglyceride is present in an amount within the range of from 0.1% to 3% by weight, based on a total weight of the moist filling material, and wherein the monoglyceride is not used as a flavouring agent;

wherein the oral pouched nicotine product does not comprise a tobacco material, and wherein the particulate non-tobacco material, the non-encapsulated non-particulate flavouring agent, the nicotine source, the pH adjusting agent, and the monoglyceride are substantially homogeneously mixed within the moist filling material so as to be provided as a uniform mixture.

2. The oral pouched nicotine product according to claim 1, wherein the moist filling material has a moisture content within the range of from 10% to 60% by weight, based on the total weight of the moist filling material.

3. The oral pouched nicotine product according to claim 1, wherein the monoglyceride is a single monoglyceride or a mixture of different monoglycerides.

4. The oral pouched nicotine product according to claim 1, wherein the monoglyceride comprises one or more of the following: sunflower oil, soybean oil, cottonseed oil, safflower oil, lard, tallow, palm oil, coconut oil, coconut fat, rapeseed oil, cocoa butter, palmolein oil, shea butter, mango kernel oil, corn oil, olive oil, peanut oil, almond oil, jojoba oil, avocado oil, linseed oil, rosehip seed oil, argan oil, sesame oil, macadamia oil, wheat germ oil, broccoli seed oil, grape seed oil, thistle oil, walnut oil, palm kernel oil, cotton seed oil, canola oil, mustard oil, beech nut oil, cashew oil, hazelnut oil, pecan oil, pine nut oil, pistachio oil, grapefruit seed oil, lemon oil, orange oil, pumpkin oil, watermelon seed oil, citrus oils, oils from melons and gourd seeds, or flaxseed oil.

5. The oral pouched nicotine product according to claim 1, wherein the moist filling material comprises within the range of from 30% to 80% by weight of the particulate non-tobacco material, based on the total weight of the moist filling material.

6. The oral pouched nicotine product according to claim 1, wherein the particulate non-tobacco material comprises a cellulose selected from the group consisting of microcrystalline cellulose and powdered cellulose.

7. The oral pouched nicotine product according to claim 1, wherein the non-encapsulated non-particulate flavouring agent is a hydrophobic flavouring agent.

8. The oral pouched nicotine product according to claim 1, wherein the non-encapsulated non-particulate flavouring agent is an oil, a liquid or a mixture thereof.

9. The oral pouched nicotine product according to claim 1, wherein the moist filling material comprises within the range of from 0.5% to 3.0% by weight of the flavouring agent, based on the total weight of the moist filling material.

10. The oral pouched nicotine product according to claim 1, wherein the moist filling material comprises within the range of from 1.0% to 10% by weight of the nicotine source, based on the total weight of the moist filling material.

11. The oral pouched nicotine product according to claim 1, wherein the nicotine source is:

a nicotine salt selected from nicotine hydrochloride, nicotine dihydrochloride, nicotine monotartrate, nicotine bitartrate, nicotine bitartrate dihydrate, nicotine sulphate, nicotine zinc chloride monohydrate, nicotine salicylate, or any combination thereof, nicotine base, or nicotine bound to an ion exchange resin.

12. The oral pouched nicotine product according to claim 1, wherein the moist filling material further comprises one or more water-insoluble fibers selected from the group consisting of maize fibers, oat fibers, tomato fibers, barley fibers, rye fibers, sugar beet fibers, buck wheat fibers, wheat fibers, pea fibers, potato fibers, apple fibers, cocoa fibers, bamboo fibers, citrus fibers, and any combination thereof.

13. A method for manufacturing a moist filling material, said method comprising:

providing a mixture comprising a particulate non-tobacco material and a nicotine source, adding monoglyceride to the mixture comprising a particulate non-tobacco material and said nicotine source thereby providing a mixture comprising particulate non-tobacco material, nicotine source, and monoglyceride, adding water to the mixture comprising said non-tobacco material, nicotine source, and monoglyceride, wherein a pH adjusting agent is added during or after any of the foregoing steps, a non-encapsulated flavouring agent is added during or after any of the foregoing steps, wherein the monoglyceride is provided in an amount within the range of from 0.1% to 3% by weight, based on a total weight of the moist filling material, and wherein the monoglyceride is not used as a flavouring agent, and wherein the particulate non-tobacco material, the non-encapsulated non-particulate flavouring agent, the nicotine source, the pH adjusting agent, and the monoglyceride are substantially homogeneously mixed within the moist filling material so as to be provided as a uniform mixture.

14. The method according to claim 13, further comprising enclosing the moist filling material in a saliva-permeable pouch of a packaging material thereby providing an oral pouched nicotine product.

* * * * *